US008118038B2

(12) United States Patent
White-Beaudet et al.

(10) Patent No.: US 8,118,038 B2
(45) Date of Patent: Feb. 21, 2012

(54) POWERED MASCARA APPLICATOR

(75) Inventors: Valerie White-Beaudet, Williamstown, VT (US); John Castaldi, Brooklyn, NY (US)

(73) Assignee: Valerie White-Beaudet, Williamstown, VT (US)

( * ) Notice: Subject to any disclaimer, the term of this patent is extended or adjusted under 35 U.S.C. 154(b) by 491 days.

(21) Appl. No.: 12/319,852

(22) Filed: Jan. 13, 2009

(65) Prior Publication Data

US 2010/0175707 A1 Jul. 15, 2010

(51) Int. Cl.
*A45D 40/26* (2006.01)
*A46B 11/00* (2006.01)

(52) U.S. Cl. ..... 132/218; 132/129

(58) Field of Classification Search ..... 132/218, 132/317, 318; 401/129, 126, 127, 122
See application file for complete search history.

(56) References Cited

U.S. PATENT DOCUMENTS

| | | | | |
|---|---|---|---|---|
| 7,165,906 | B2 * | 1/2007 | Dieudonat et al. | 401/127 |
| 7,654,271 | B2 * | 2/2010 | Wyatt et al. | 132/218 |
| 2009/0025746 | A1 * | 1/2009 | Kim et al. | 132/217 |
| 2011/0110701 | A1 * | 5/2011 | Gueret | 401/126 |

FOREIGN PATENT DOCUMENTS

| | | | |
|---|---|---|---|
| EP | 2172125 | A1 * | 4/2010 |
| GB | 2452495 | A * | 3/2009 |

* cited by examiner

*Primary Examiner* — Robyn Doan
(74) *Attorney, Agent, or Firm* — Gertner Mandel & Peslak, LLC; Arthur M. Peslak

(57) ABSTRACT

What is disclosed is an electric motor powered mascara applicator brush. The mascara applicator brush comprises a cylindrical container and provides for two components of rotation of the brush and more even distribution of the mascara around the eyelashes.

5 Claims, 4 Drawing Sheets

POWERED MASCARA APPLICATOR

BACKGROUND OF THE INVENTION

The present invention relates to the field of applicators for cosmetics. In particular, the present invention is directed to the field of applicators for mascara. Mascara is a cosmetic applied to the eyelashes. Most available mascara containers are provided with a manual brush applicator that sometimes makes it difficult to apply the mascara. The presently available applicators suffer from various defects that sometimes make it difficult for the user to apply. One of the difficulties of applying mascara with available applicators is that it is difficult to apply mascara to the corner of the eyelashes without clumping of the mascara.

The primary object of the present invention is to overcome these difficulties through the means of a battery operated, self-propelling rotary mascara brush that works in combination with existing mascara containers. The applicator of the present invention provides a novel motion of the brush with two components of rotation that sweeps the mascara evenly on the eyelashes from end to end.

SUMMARY OF THE INVENTION

A motorized mascara applicator for use with available mascara brushes comprising a generally cylindrical barrel comprising a longitudinal axis, a distal end, a proximal end and an opening at the distal end, a battery operated DC Motor contained within the barrel wherein the DC motor comprises an output shaft with a concave disk on an end thereof and wherein the output shaft rotates about the longitudinal axis in either a clockwise or counterclockwise direction, a first switch accessible from outside the barrel in electrical contact with the DC Motor for turning the DC Motor on or off and for selecting the direction of rotation of the output shaft, a sphere adapted to be received in the opening at the distal end of the barrel wherein the sphere partially projects above the distal end and is adapted to rotate freely in the opening, a brush shaft with a first end and a second end comprising a mascara brush on the first end and a handle on the second end whereby the handle is adapted to be removably rigidly mounted in a mating opening on the sphere and the shaft can be displaced by the user from the longitudinal axis by an angle in any direction by rotating the sphere; and a second switch for engaging the concave disk to the sphere and thereby causing the sphere to rotate after the first switch turns on the DC motor wherein the output shaft rotates thereby causing the mascara brush to rotate about the brush shaft and also about the longitudinal axis when the shaft is displaced by the user from the longitudinal axis.

DETAILED DESCRIPTION OF THE PRESENT INVENTION

Figure 1:
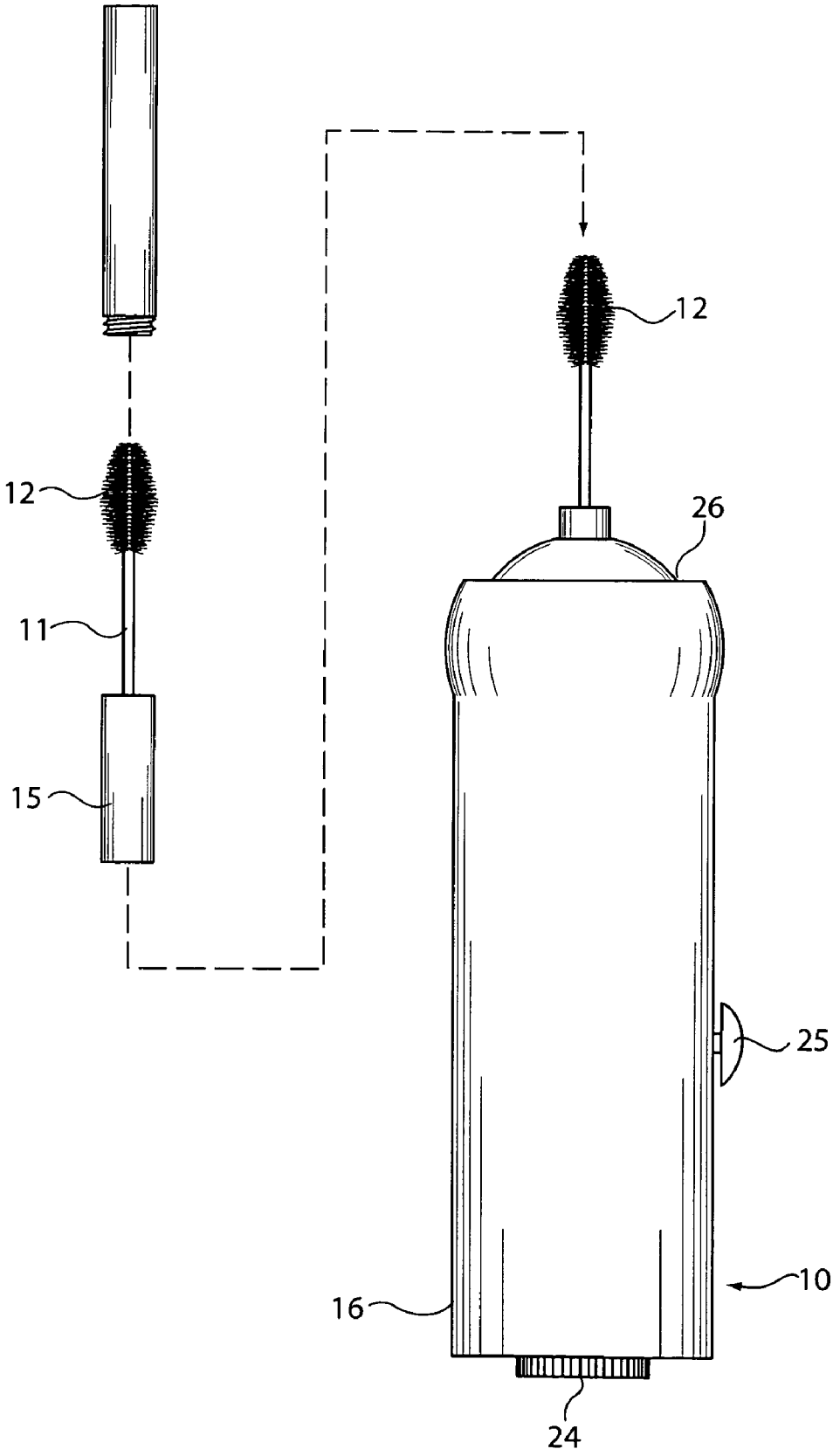
FIG. 1 is a plan view of an available mascara container with the present invention.
Figure 2:
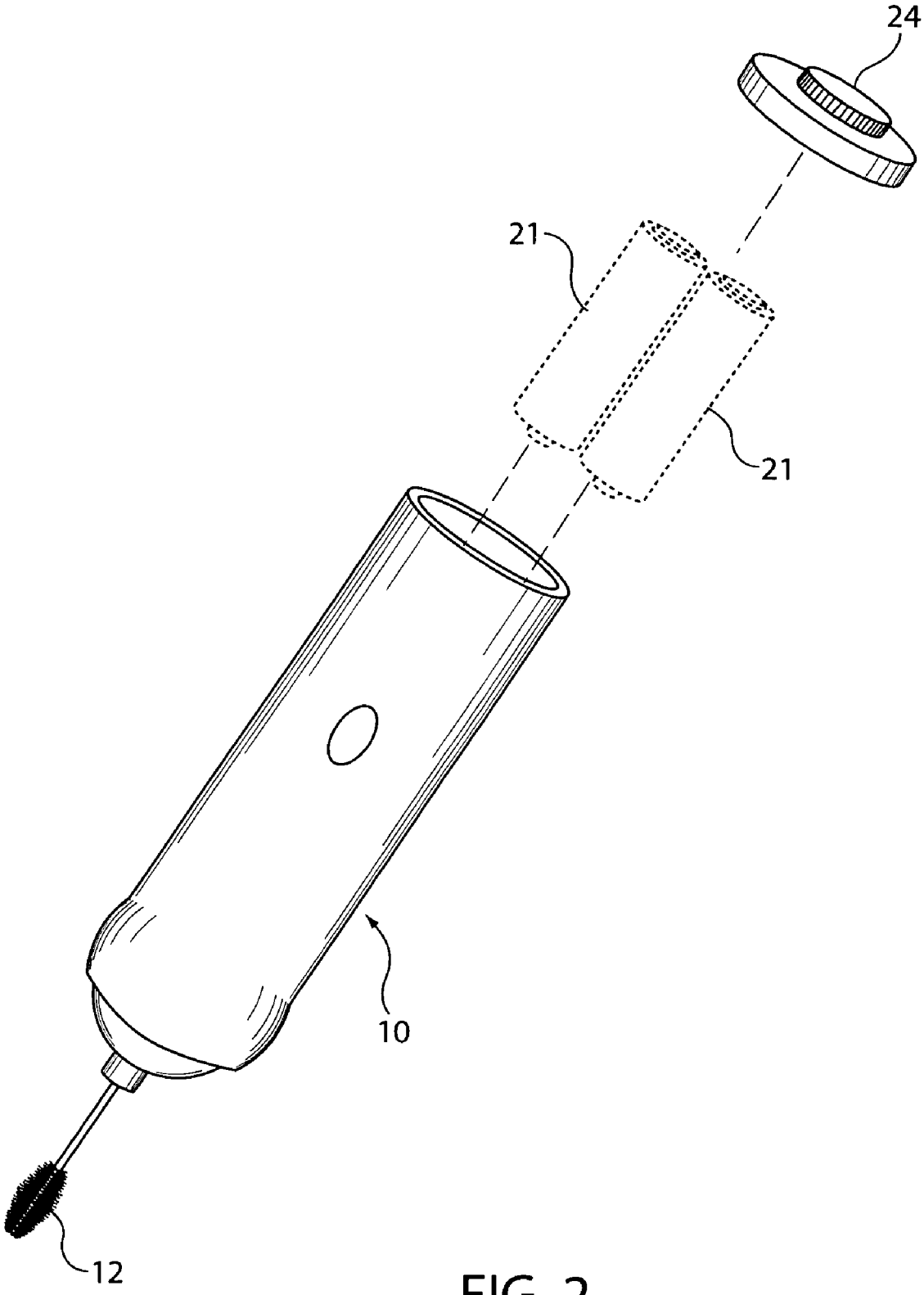
FIG. 2 is a partially exploded view of an embodiment of the present invention.

The present invention will now be described in terms of the presently preferred embodiment thereof as illustrated in the drawings. Those of ordinary skill in the art will recognize that many obvious changes may be made thereto without departing from the spirit or scope of the present invention.

The mascara applicator 10 of the present invention comprises a battery operated device to impart rotary motion to a mascara brush 12. The applicator 10 is adapted to be used with a commercially available mascara brush 12 from available mascara containers as shown in FIG. 1. The novel feature of the applicator 10 is that it imparts two components of rotation of the brush 12 as explained below.

The mascara applicator 10 comprises a generally cylindrically shaped barrel 16. The cylindrically shaped barrel 16 comprises a longitudinal axis 17, a proximal end 13 and a distal end 19. The barrel 16 contains a battery powered motor 18. In the presently preferred embodiment, the motor 18 would be powered by two 'AAA" batteries 21. The motor 18 itself is an available DC motor. The motor 18 comprises an output shaft 20 that is coupled to a concave disk 22.

The proximal end 13 of the barrel 16 comprises a switch 24 in electrical contact with the batteries 21. The first switch 24 turns the motor 18 on or off by putting the batteries 21 in electrical contact with the motor 18. The barrel 16 also comprises a second switch 25 which controls the motion of the brush 12 as described below. The distal end 19 comprises an opening 26 through which a sphere 28 partially protrudes. The sphere 28 can turn freely in the opening 26 at the distal end.

The brush 12 comprises a shaft 11. The shaft 11 is connected to a cylindrical handle 15. A mounting hole 29 in the sphere 28 is adapted to receive the handle 15. The handle 15 is inserted in the mounting hole 29 and held in place by a plurality of spring fingers 32. The spring fingers 32 are adapted to receive handles 15 of varying diameters and still hold the brush in place. In order to use the applicator 10, the handle 15 is removed from the available mascara 13. The handle 15 is then placed into the mounting hole 29.

Figure 3:
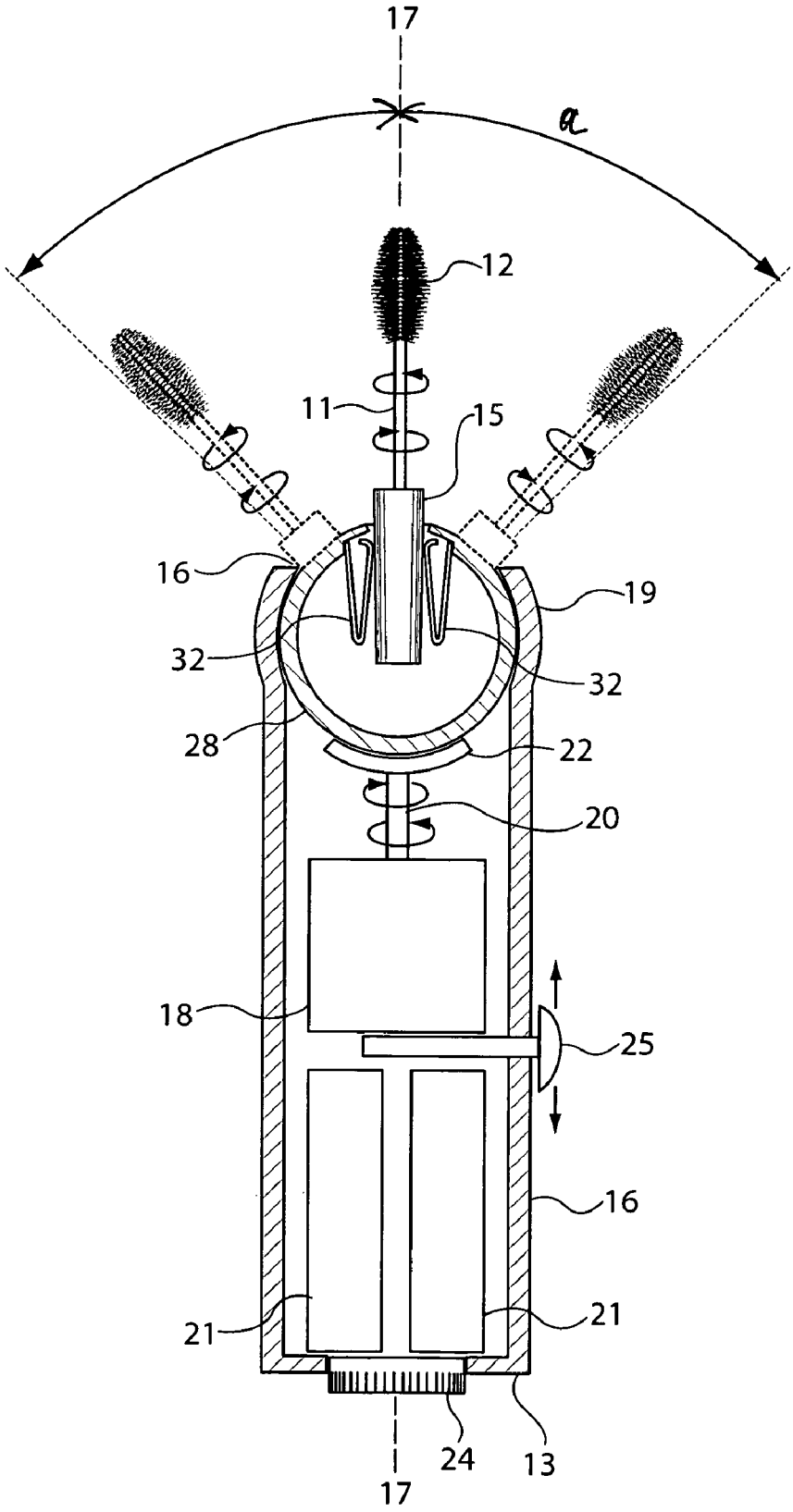
FIG. 3 is a cross-sectional side view of an embodiment of the present invention.
Figure 4:
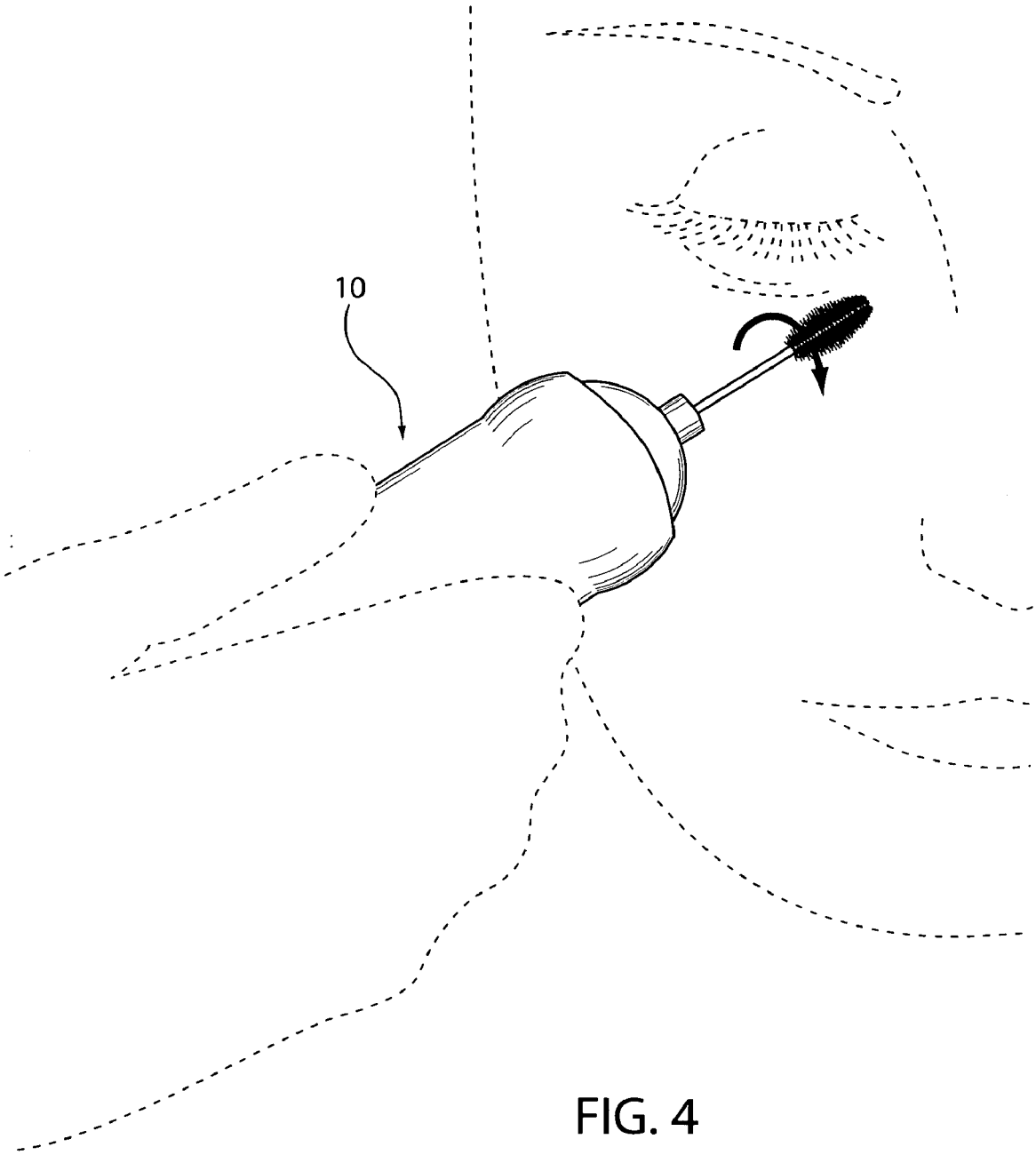
FIG. 4 is a plan view illustrating the use of an embodiment of the present invention.

In operation, the first switch 24 is used to turn on the electric motor 18. The second switch 25 when moved toward the distal end 14 causes the concave disk 22 to contact the bottom of the sphere 28. The concave disk 22 is adapted to match the radius of the sphere 28. Thus, as the concave disk 22 begins to rotate, the sphere 28 will rotate and the brush 12 will rotate about its shaft 11. If the shaft 11 of the brush 12 is aligned with the longitudinal axis 17, the brush 12 will merely rotate around its shaft 11 and the axis 17. However, if the user moves the brush 12 off the axis 17 by an angle "a", as illustrated in FIG. 3, the rotating motion of the brush 12 will have 2 components. First, the brush 12 will continue to rotate circularly about the shaft 11 but a second rotational or orbital component of the motion will result from the effect of the shaft 11 being displaced from the axis 17 of the barrel 16 by the angle a. The dual component of the rotation allows for more application of the mascara to the corners of the user's eyelashes by sweeping the mascara outward along the eyelash. In the normal user movement wherein the entire brush is swept over the eyelash manually or by merely rotating the brush 12 about its shaft 11, clumps of mascara will buildup on the eyelashes. With the present invention, the mascara is applied smoothly without clumping and thereby adds a major dimension to the corners of the eyelashes.

The first switch 24 can also be used to create either clockwise or counterclockwise motion of the output shaft 20. In turn, the brush 12 will similarly rotate in the chosen direction. It is anticipated that the user would select clockwise rotation for applying mascara to the lower eyelash and shift to the counterclockwise rotation for applying mascara to the upper eyelashes.

Those of ordinary skill in the art will recognize that many obvious modifications may be made to the present invention without departing from the spirit of scope of the present invention as set forth in the appended claims.

What is claimed is:

1. A motorized mascara applicator for use with available mascara brushes comprising:

a) A generally cylindrical barrel comprising a longitudinal axis, a distal end, a proximal end and an opening at the distal end;

b) A battery operated DC Motor contained within the barrel wherein the DC motor comprises an output shaft with a concave disk on an end thereof and wherein the output shaft rotates about the longitudinal axis in either a clockwise or counterclockwise direction;

c) A first switch accessible from outside the barrel in electrical contact with the DC Motor for turning the DC Motor on or off and for selecting the direction of rotation of the output shaft;

d) A sphere adapted to be received in the opening at the distal end of the barrel wherein the sphere partially projects above the distal end and is adapted to rotate freely in the opening;

e) A brush shaft with a first end and a second end comprising a mascara brush on the first end and a handle on the second end whereby the handle is adapted to be removeably rigidly mounted in a mating opening on the sphere and the shaft can be displaced by the user from the longitudinal axis by an angle in any direction by rotating the sphere;

f) A second switch for engaging the concave disk to the sphere and thereby causing the sphere to rotate after the first switch turns on the DC motor wherein the output shaft rotates thereby causing the mascara brush to rotate about the brush shaft and also about the longitudinal axis when the shaft is displaced by the user from the longitudinal axis.

2. A motorized mascara applicator brush device wherein the brush applies mascara to the eyelashes by means of rotation around an axis of the brush and orbital motion of the brush around a centerline of the applicator brush device.

3. The mascara applicator brush device of claim 2 further comprising:

a) A container comprising a longitudinal axis;

b) A motor mounted within the container comprising an output shaft;

c) A rotating member adapted to be rotated by the output shaft; and d) A brush shaft wherein the shaft is attached to the rotating member wherein the rotating member causes the brush to rotate circularly about the axis of the brush and also causes the brush to simultaneously orbit about the rotating member.

4. The mascara applicator brush device of claim 3 wherein the output shaft comprises a concave disk is adapted to impart rotational motion to the rotating member.

5. The mascara applicator brush device of claim 4 wherein the rotational member comprises a center point aligned with the longitudinal axis and wherein the brush shaft can be displaced through an angle by rotating the rotating member so that the brush shaft orbits about the rotating member.

* * * * *